United States Patent [19]

Halder

[11] Patent Number: 4,737,172

[45] Date of Patent: Apr. 12, 1988

[54] TEXTILE MACHINE AIR FILTER

[75] Inventor: Ernst Halder, Wäschenbeuren, Fed. Rep. of Germany

[73] Assignee: Zinser Textilmaschinen GmbH, Ebersbach, Fed. Rep. of Germany

[21] Appl. No.: 892,098

[22] Filed: Jul. 30, 1986

[30] Foreign Application Priority Data

Aug. 1, 1985 [DE] Fed. Rep. of Germany ..... 3527656

[51] Int. Cl.[4] ..... B01D 46/00

[52] U.S. Cl. ..... 55/273; 55/283; 55/284; 55/287; 55/296; 55/429

[58] Field of Search ..... 55/283, 272, 273, 287, 55/288, 296–298, 432, 284, 429

[56] References Cited

U.S. PATENT DOCUMENTS

| | | | |
|---|---|---|---|
| 1,713,880 | 5/1929 | McLean | 55/296 |
| 2,036,534 | 4/1936 | Mairhead | 55/288 |
| 3,221,479 | 12/1965 | Moser et al. | 55/296 |
| 3,951,623 | 4/1976 | Furstenberg | 55/283 |
| 4,006,033 | 2/1977 | Schewe | 55/296 |
| 4,306,891 | 12/1981 | Clarke et al. | 55/465 |

FOREIGN PATENT DOCUMENTS

| | | | |
|---|---|---|---|
| 2028410 | 12/1970 | Fed. Rep. of Germany . | |
| 1510317 | 5/1971 | Fed. Rep. of Germany . | |
| 75324764 | 10/1975 | Fed. Rep. of Germany . | |
| 2926725 | 2/1981 | Fed. Rep. of Germany . | |
| 3010011 | 9/1981 | Fed. Rep. of Germany . | |
| 3121521 | 1/1983 | Fed. Rep. of Germany . | |
| 3333033 | 3/1984 | Fed. Rep. of Germany . | |
| 3242929 | 5/1984 | Fed. Rep. of Germany . | |
| 3340672 | 6/1985 | Fed. Rep. of Germany . | |
| 740118 | 11/1932 | France | 55/296 |
| 420808 | 3/1967 | Switzerland . | |

*Primary Examiner*—Bernard Nozick

*Attorney, Agent, or Firm*—Karl F. Ross; Herbert Dubno

[57] ABSTRACT

A textile machine filter has its filter surface divided into zones which can be independently wiped by a stripper movable into juxtaposition with the zones or by respective strippers assigned to each one. A common collection space is provided beneath the filter surface to receive the contaminants from each zone.

15 Claims, 3 Drawing Sheets

TEXTILE MACHINE AIR FILTER

FIELD OF THE INVENTION

My present invention relates to a textile machine filter for removing fluff, fiber, dust and other impurities from air which is drawn from a textile machine, especially a spinning machine. More particularly, the invention relates to a filter structure for such textile machines which can be equipped with a suction manifold or pipe drawing air carrying yarn ends and roving fibers from such stations as the spinning and drafting or drawing stations of the spinning frame.

BACKGROUND OF THE INVENTION

It has been proposed to provide filter units for textile machines which contain two filter chambers (German open application DE-OS No. 30 10 011) which can be connected selectively to the intake pipe by respective flap valves and which can have flap valves at their outlets for selective communication with the intake side of a blower or with an air-evacuation pipe or passage. The sets of flaps can be provided with common actuators.

This construction allows one of the compartments to be used to filter fibers, fluff and other solids entrained by the air from the latter upon the opening of the flaps associated with that compartment while the other compartment is closed off for cleaning.

In practice this arrangement does not preclude a filter surface which is in the closed-off compartment from accumulating contaminants. Another drawback of the earlier system is that it is relatively complex in construction and requires considerable maintenance.

OBJECTS OF THE INVENTION

It is the principal object of the present invention to provide an improved textile machine filter in which selected surfaces can be closed off for cleaning without difficulties of the type encountered heretofore with earlier systems.

Yet another object of the invention is to provide an improved apparatus which is relatively simple by comparison to the earlier devices and can be operated and maintained much more simply and economically.

Still another object of the invention is to provide a textile machine filter of the simplest possible construction but one which nevertheless will allow selected filter surfaces to be free from collection of impurities.

SUMMARY OF THE INVENTION

These objects are attained, in accordance with the present invention, with a filter having at least one filter surface which preferably is planar and is laterally subdivided into at least two adjacent zones which can be selectively wiped or scrubbed by a stripper element displaceable by a respective actuator such as a fluid-controlled piston-and-cylinder operator while beneath this upright filter surface a collection space is provided for solids dislodged from that surface.

This system has the important advantage that as may be necessary a part of the filter surface, i.e. one of the zones, may be cleaned even while the unit remains in operation, with the material wiped from the filter surface being pressed by the stripper into the collection space. The partial surfaces of the filter which are individually wiped by the stripper can form part of a single continuous planar surface although it is conceivable to provide, in accordance with the invention, partial surfaces which are not directly adjacent to one another to form the zones.

The filter surfaces can be inclined to one another or stacked or staggered and according to the invention, each zone can be provided with a respective stripper and its operator. Alternatively, especially when the zones are adjacent to one another on a common planar filter surface, means can be provided to shift a single stripper selectively into juxtaposition with the zones.

According to a feature of the invention, each stripper is connected to a cover element or closure which in the actuated position of the stripper completely covers the respective zone or partial surface of the filter surface thereby precluding deposit of the solids from the air drawn through this filter surface on the covered region. The closure, actuator or operator and the stripper form collectively, therefore, a stripper unit, one of which may be provided for each zone, these units being actuated alternately when two such units are provided.

Of course, when a single unit is provided for a plurality of zones, the zones can be alternately juxtaposed with the stripper of the unit which can be moved back and forth along the filter surface by a shifting device.

The stripper operator can be a piston-and-cylinder unit which preferably is pneumatically operated and the shifting device can likewise be a pneumatically operated piston-and-cylinder unit.

The operators and the shifting unit can be controlled by a timer or a differential pressure sensor which initiates cleaning when a pressure drop across a dust collection zone indicates that this zone requires cleaning. This provides an automated cleaning operation for the filter.

According to a further feature of the invention, each stripper is provided with an elastic lip which wipes or scrubs along the filter surface and is connected to a plate forming the closure and having an area and dimensions corresponding to the zone which to be covered by this closure.

To ensure that the solids which are stripped from the filter surface remain in the collection space after the stripper is retracted, an opening may be provided for this collection space through which the stripper can pass and which is provided with sealing bars or other means elastically cooperating with the stripper and preventing the escape of solids forced through this opening.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
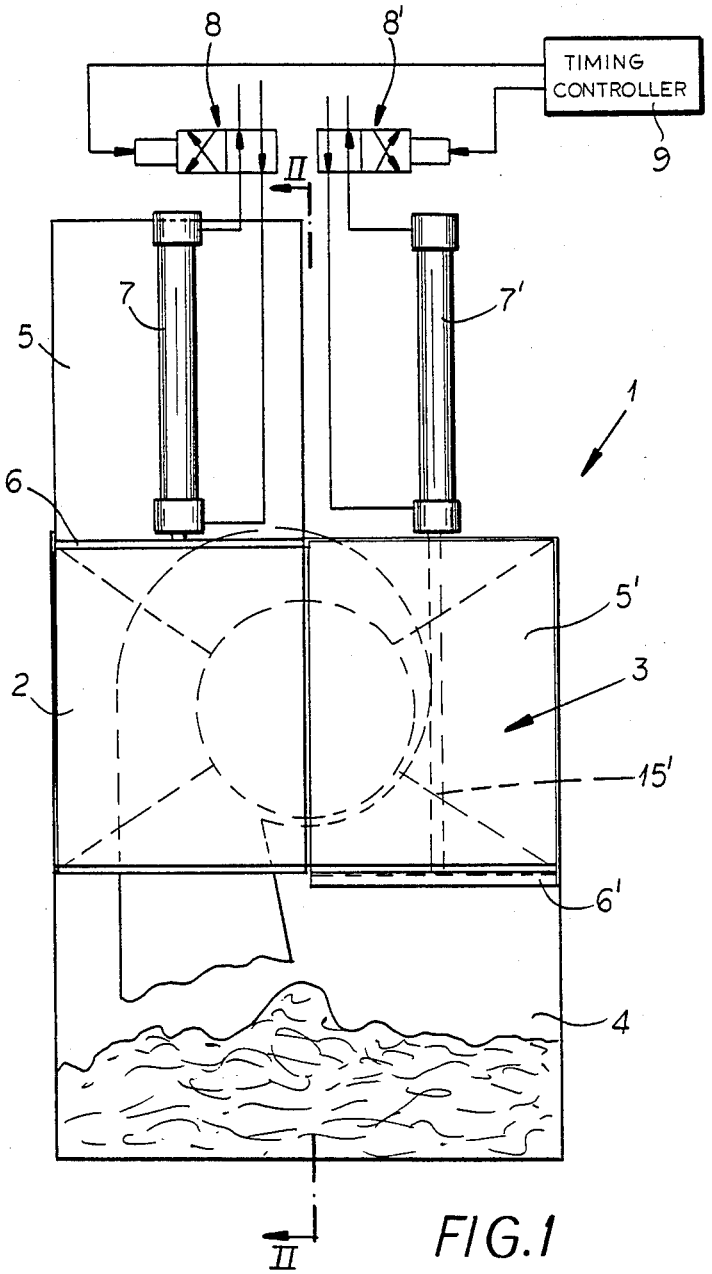
FIG. 1 is a diagrammatic front elevational view of a textile machine filter according to the invention whose filter surface has two zones, one of which is covered by the aforementioned closure.

FIG. 1 shows a textile machine filter whose filter casing 1 is provided with a vertical planar filter surface which is subdivided into two adjacent zones 2, 3. Below these filter zones or partial filter zones 2, 3, there is provided a common collection space 4 to receive the fiber, fluff, and other impurities which are filtered from the air. As is apparent from FIG. 2, the filter chamber 1 is provided downstream from an intake passage 10 which can have openings at the various stations of the textile machine for drawing the fluff, broken yarn, roving pieces and the like, in entrainment with the air to the filter surface 2, 3.

The air displacement is induced by a blower 11 whose intake side communicates with the casing 1 and which has a discharge passage 16 for the air from which the solid impurities are filtered. The blower 11 is driven by an electric motor 12 via a V-belt transmission. The air flow through the filter 2, 3 is thus represented by the arrow traversing it from the intake duct 10 through the filter surface 2, 3, through the impeller or rotor of the axial-intake tangential-outflow blower and then through the discharge passage 16. The solid impurities are collected on the surface 2, 3.

In this embodiment, each of the partial filter surfaces, or zones 2, 3 is provided with a respective stripper 6, 6' carrying a respective closure plate 5, 5'.

Figure 2:
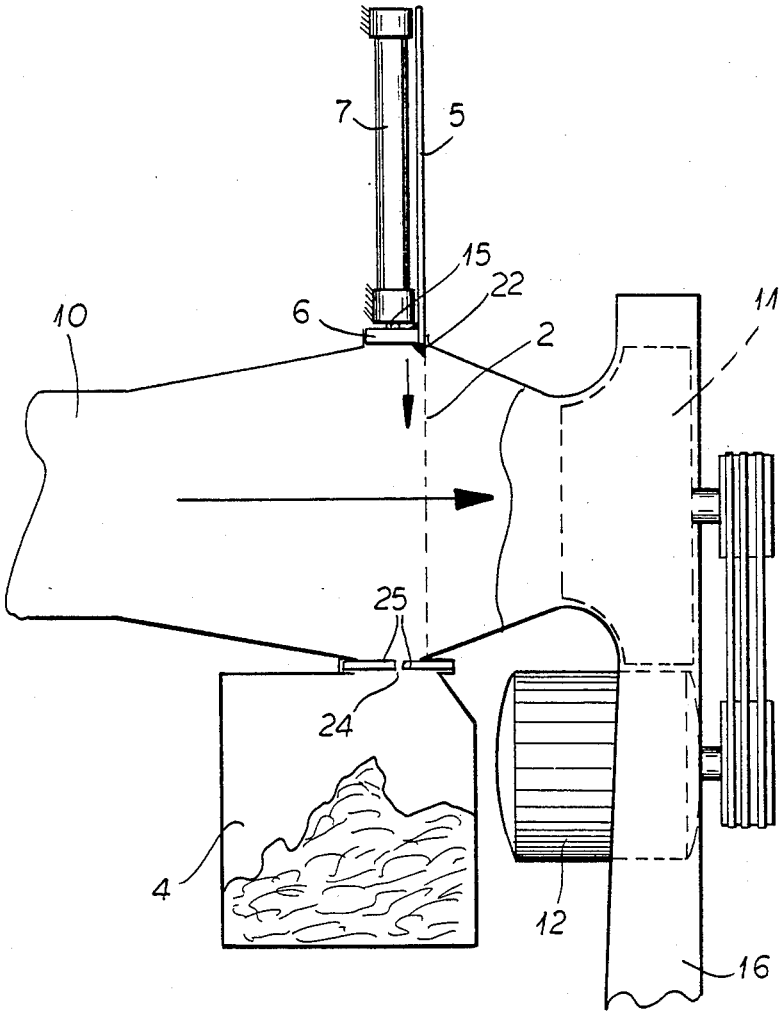
FIG. 2 is a diagrammatic section along the line II—II of FIG. 1.

As is also apparent from FIG. 2, each plate, as is clearly visible for the plate 5', has an area corresponding to the respective zone 2, 3.

On the underside of each stripper 6, 6', an elastic stripping lip 22 is provided which can scrape against the filter surface 2, 3.

Each stripper 6 or 6' and the respective closure plate 5 or 5' is operatively connected to the piston rod 15 of a respective piston-and-cylinder unit 7 or 7'. Each stripper element closure element and piston-and-cylinder unit thus forms a stripper unit in accordance with the invention.

In the positions shown in FIG. 1, the piston rod 15' of the cylinder 7' is fully extended and the stripper 6' has completed wiping of the respective zone 3, forcing the removed solids into the collection space 4 through an opening 24 past a pair of elastic lips 25 (FIG. 2) which hug the stripper 6' or the rod 15' and close together upon retraction of the stripper to thereby prevent escape of the solids from the collection space 4.

During the cleaning process, the plate 5' completely closes off the surface of the cleaned zone 3 so that there is no danger that solids will collect on the filter surface in this zone.

The zone 2, however, remains fully functional and contaminants can accumulate thereon.

Upon retraction of the piston rod 15', the partial filter surface 3' is unblocked and can collect contaminants from the air traversing same. The stripper 6 and its closure 2 can then be advanced by the piston-cylinder unit 7 to wipe the zone 2 in like manner.

For alternate operation of the piston-cylinder units 7 and 7', I provide control valves 8 and 8' which can be operated by a unit 9 such as a microprocessor or other programmable controller which can include a timer which is adjustable to operate the valves 8 and 8' alternately at selected time intervals.

Figure 3:
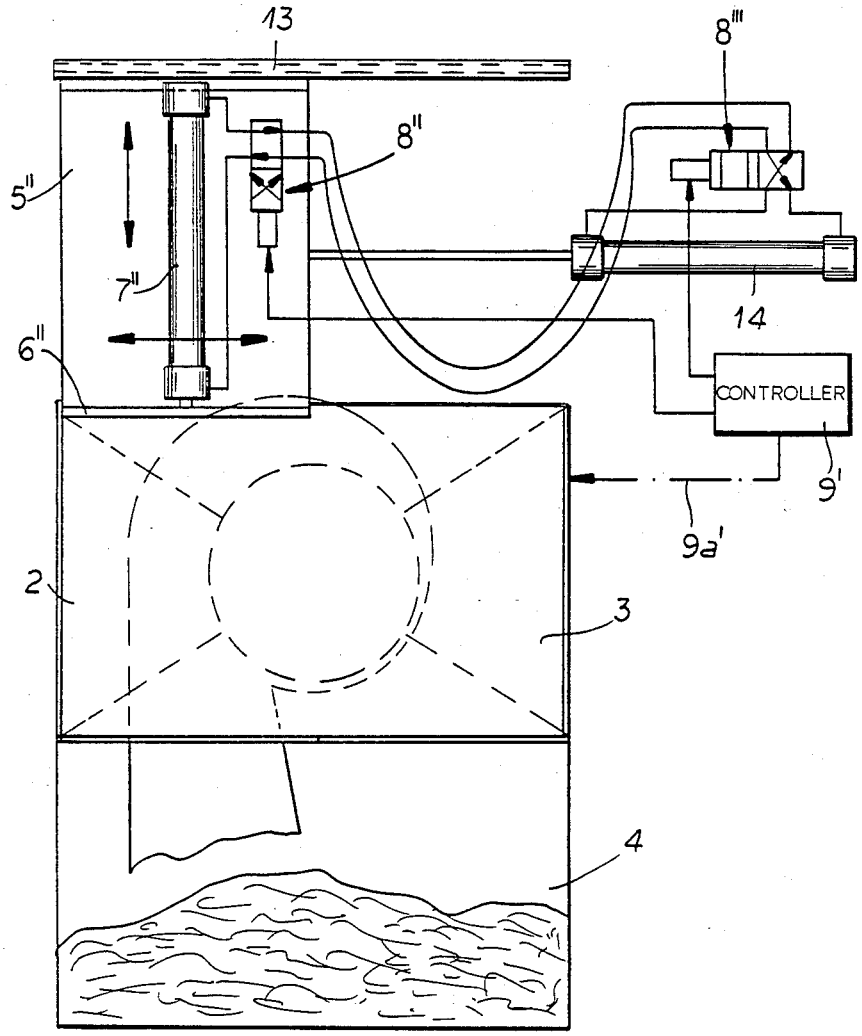
FIG. 3 is a front elevational view diagammatically illustrating another embodiment of the invention.

Alternatively, as has been shown in FIG. 3 by the arrow 9a', the controller 9' can be provided with a differential pressure sensor measuring the difference between the atmospheric pressure ahead of and downstream of the filter surface 2, 3 for selective actuation of the valves 8 and 8' when the pressure differential signals the fact that one of these zones requires cleaning.

In the embodiment of FIG. 3, a single stripper 6' with its closure 5' and operator 7' form a stripper unit which can be selectively shifted from one zone 2 to the other zone 3.

In the embodiment of FIG. 3, moreover, the controller 9' not only controls the valve 8' for the operator 7', but also controls a valve 8''' causing extension or retraction of the pneumatic cylinder 14 forming the shifting device for the unit 5', 6', 7'. For each zone, of course, the stripper and closure operate in the manner described.

Naturally, in place of piston-and-cylinder units, threaded spindles, rack and pinion drives, or the like, driven by electric motors can be used.

Furthermore, the piston rods 15 and 15' can be covered by plates or shields on the closure plates 5, 5' or 5'' or plates parallel thereto to prevent contamination of the piston rods with fluff or the like. The piston also may be received in bellows like sleeves.

In the embodiment of FIGS. 1 and 2, the piston-and-cylinder units 7 and 7' are provided with respective control valves 8 and 8' so that the two piston-and-cylinder units can be independently moved.

Normally both units will be found in their uppermost positions leaving both filter zones 2 and 3 free to collect contaminants. Only during brief cleaning periods are the respective strippers lowered.

I claim:

1. A textile machine filter for removing fluff, fiber, dust and other solid impurities from air drawn from a textile machine, said filter comprising:

a casing;

means for drawing a flow of solids-entraining air from said textile machine through said casing;

means forming on said casing at least one rectangular and generally planar filter surface subdivided into first and second adjacent and generally coplanar and rectangular zones traversed by said flow of air, whereby solids entrained by said flow of air collect on said surface, each of said zones being defined between opposite parallel edges;

a stripper blade juxtaposable with each of said zones and constructed and arranged for linear displacement from one of said edges thereof over said zone to the opposite respective edge in a direction perpendicular to the stripper blade between an unactuated position with the blade generally at the respective one edge to an actuated position generally at the respective opposite edge to dislodge collected solids from the respective zone, whereby each zone is stripped independently of the other zone;

a closure plate fixed to and movable with the blade and of generally the same size as the respective zone, the plate covering and substantially blocking flow through the respective zone in the actuated position of the one blade;

at least one reciprocating actuator operatively connected to said stripper blade and to the respective plate for linearly and jointly displacing same back and forth across at least the respective zone;

means including a lateral shifting unit for displacing the blade and plate between a first position movable across the first zone and a second position movable across the second zone, whereby during stripping and blocking of one of the zones the other zone continues to filter said air; and means in said casing defining below said surface a collection space for the solids dislodged from said surface.

2. The textile machine filter defined in claim 1 wherein the actuator is a fluid-operated piston-cylinder operator.

3. The textile machine defined in claim 1, further comprising timer means connected to the actuator for periodically operating same to strip the zones.

4. The textile machine defined in claim 1, further comprising differential-pressure sensing means connected to the actuator for displacing the stripper blade across the zones when the pressure differential across the surface exceeds a predetermined limit.

5. The textile machine filter defined in claim 1 wherein said stripper blade is formed with an elastic lip bearing upon said surface.

6. The textile machine filter defined in claim 1, further comprising means forming an opening communicating with said collection space and provided with a seal through which said stripper blade can pass.

7. The textile machine filter defined in claim 1 wherein the lateral shifting unit includes a fluid-operated piston-cylinder operator.

8. The textile machine filter defined in claim 7 wherein said fluid-operated piston-cylinder operator is a pneumatic cylinder.

9. A textile machine filter for removing fluff, fiber, dust and other solid impurities from air drawn from a textile machine, the filter comprising:

a casing;

means for drawing a flow of solids-entraining air from the textile machine through the casing;

means forming on the casing at least one rectangular and generally planar filter surface subdivided into first and second adjacent and generally coplanar and rectangular zones traversed by the flow if air, whereby solids entrained by the flow of air collect on the surface, each of the zones being defined between opposite parallel edges;

first and second stripper blades independently juxtaposable with each of the zones and constructed and arranged for linear displacement from one of the edges of the respective zone to the opposite respective edge in a direction perpendicular to the respective stripper blade between an unactuated position with the blade generally at the respective one edge to an actuated position generally at the respective opposite edge to dislodge collected solids from the respective zone, whereby each zone is stripped independently of the other zone;

first and second closure plates fixed to and movable with the blades and of generally the same size as the respective zones, the plates covering and substantially blocking flow through the respective zones in the actuated position of the respective blade;

first and second reciprocating actuators operatively connected to the stripper blades and to the respective plates for linearly and jointly displacing same back and forth across at least the respective zone;

control means for alternately operating the actuators such that during stripping and blocking of one of the zones the other zone continues to filter the air; and means in the casing defining below the surface a collection space for the solids dislodged from the surface.

10. The textile machine filter defined in claim 9, further comprising timer means connected to the actuators for periodically operating same to strip the zones.

11. The textile machine defined in claim 9, further comprising differential-pressure sensing means connected to the actuators for displacing the respective stripper blades across the zones when the pressure differential across the surface exceeds a predetermined limit.

12. The textile machine defined in claim 9 wherein the stripper blade is formed with an elastic lip bearing upon the surface.

13. The textile machine defined in claim 9, further comprising means forming an opening communicating with the collection space and provided with a seal through which the stripper blade can pass.

14. The textile machine filter defined in claim 9 wherein the actuator is a fluid-operated piston-cylinder operator.

15. The textile machine filter defined in claim 14 wherein the fluid-operated piston-cylinder operator is a pneumatic cylinder.

* * * * *